US005205076A

United States Patent [19]

Vernon et al.

[11] Patent Number: 5,205,076

[45] Date of Patent: Apr. 27, 1993

[54] SELF-ALIGNED LENS MANUFACTURING SYSTEM AND METHOD

[75] Inventors: Edward W. Vernon; Thomas E. Nelson, both of Santa Barbara, Calif.

[73] Assignee: Development Associates Controls, Inc., Carpinteria, Calif.

[21] Appl. No.: 676,762

[22] Filed: Mar. 27, 1991

[51] Int. Cl.[5] ..... B24B 3/00

[52] U.S. Cl. ..... 51/95 R; 51/105 R; 51/105 LG; 51/124 L; 51/216 LP

[58] Field of Search ..... 51/95 R, 96, 97 R, 103 R, 51/105 R, 105 LG, 106 LG, 124 L, 216 LP

[56] References Cited

U.S. PATENT DOCUMENTS 4,239,712 12/1980 Neefe ..... 51/284 R 4,619,082 10/1986 Dent et al. ..... 51/216 LP

FOREIGN PATENT DOCUMENTS 148150 7/1987 Japan ..... 51/216 LP

*Primary Examiner*—M. Rachuba

*Attorney, Agent, or Firm*—Koppel & Jacobs

[57] ABSTRACT

Contact and intra-ocular lenses are manufactured by forming reference surfaces in a lens blank along with the inner base surface for the lens. The partially formed lens blank is then mounted to a blocking member which has complementary surfaces that mate with the reference surface and automatically align the lens blank. The blocking member has a flange that abuts against a spindle in which the member is held during formation of the outer lens surface. The known distance between the abutting surface of this flange and the reference surface on the lens blank allows the outer lens surface to be formed without having to separately measure the thickness of the lens blank, or enter dimensional information into the computer which controls the operation. A recessed collet within the spindle enables the blocking member flange to directly abut the end of the spindle.

10 Claims, 3 Drawing Sheets

SELF-ALIGNED LENS MANUFACTURING SYSTEM AND METHOD

BACKGROUND OF THE INVENTION

1. Field of the Invention

This invention relates to the formation of contact and intra-ocular lenses, and more particularly to lens manufacture with computer controlled machine tools.

2. Description of the Prior Art

The manufacture of contact and intra-ocular lenses by standard turning processes is accomplished by first creating a posterior surface in a solid lens blank, and then forming a convex surface in the blank that corresponds to the outer lens surface when the finished lens is worn. The posterior surface for a contact lens is concave, while for an intra-ocular lens it may be concave, flat or convex. The process is computer controlled using current lathe equipment. The first step of this process is illustrated in FIG. 1 for a contact lens; a similar process is employed for intra-ocular lenses. A contact lens blank 2, which initially has a "hockey puck" flat cylindrical shape, is held at the end of a hollow rotatable spindle 4. A collet 6 is carried at the front end of the spindle, and has a forward facing recess 8 into which the lens blank 2 fits. The collet 8 can be contracted about its axis in a conventional manner by withdrawing it into the interior of the spindle 4, so that only the front end of the collet protrudes out from the spindle. The spindle's forward interior surface 10 is sloped and mates with a correspondingly sloped outer surface of the collet, so that withdrawing the collet in towards the spindle causes it to clamp the lens blank 2.

A concave base curve 12 is formed in the outward facing surface of the lens blank by rotating the spindle 4 about its axis and moving it horizontally (in the X direction) against an appropriate cutting tool. The cutting tool is typically diamond-tipped, and can be mounted for translation in the vertical (Y) direction in FIG. 1 as the spindle translates in the X direction. The base curve 12 is formed by varying the protrusion of the cutting tool into the lens blank such that a maximum cutting depth is reached at the center of the base curve, and the cutting depth is gradually reduced along the desired curve as the cutting tool translates in the Y direction away from the center. Alternately, the cutting tool could be mounted upon a slide on the surface of a rotatable table with the rotation of the table, movement of the slide and translation of the spindle coordinated to produce the desired curve. The collet is loosened so that the lens blank can be removed for polishing.

Next, the lens blank's center thickness T is measured and recorded, typically by writing it in ink along its edge. This is necessary to properly align the outer lens surface, formed in the succeeding step, with the inner base curve. The partially finished lens is then mounted ("blocked") with the base curve surface carried by the head of a metal or plastic mandrel or block 14. A hot wax adhesive 16 is placed over the head of the block to receive the lens blank, and fixes the parts in relation to each other as it cools. The block 14 is held by a collet 18, a set of mechanical fingers or some other suitable mechanical device that in turn is captured at the front end of the spindle 4 and protrudes outward from the spindle.

A probe 20 is brought into contact with the outward facing surface of the lens blank 2 to determine the location of this surface relative to the spindle. The computer control then coordinates a cutting tool with the spindle movement to cut the outer lens surface. Since the center thickness of the lens blank was measured after the base curve surface was cut, the lathe equipment may be programmed to remove the proper amount of material from the lens blank to form the final lens.

The lens blank 2 must be carefully centered on the block 14 so that its optical centerline coincides with that the block. Any misalignments can seriously effect the quality of the finished lens. In general, misalignments will fall into two categories. When the centerline 22 of the lens blank 2 is offset from, but parallel to, the block's centerline 24, as illustrated in FIG. 3, a "run-out" situation exits that induces "prism" in the finished lens. It is desirable that run-out be restricted to less than 20 microns. When the lens blank 2 is shifted along the front surface of the block 14 so that its axis 22 is offset from the block axis 24 along the head surface of the block, and is also at a non-zero angle to the block axis, the situation is referred to as "wobble"; it is illustrated in FIG. 4. Like prism, it is desirable that wobble be restricted to less than 20 microns. Sometimes a prescription calls for building in a certain amount of prism and/or wobble, but the same accuracy standards also apply to this case.

The lens must be carefully centered on the block so that its optical centerline coincides as closely as possible with that of the block. As mentioned above, mechanical fingers, collets or other mechanical devices are used to attain this alignment and to hold the lens relative to the block as the blocking wax cools and solidifies. Another system that has been used to properly align the lens to the block involves holding the block in the headstock of a lathe, applying the hot wax, and then sticking the lens into position. The blocking lens assembly is then rotated, and a mechanical probe is brought up to the edge of the lens to force it into alignment with the centerline of the block while the wax is still warm and pliable.

Whichever blocking technique is used, the center thickness of the lens blank must be measured prior to blocking, and entered into the computer. Since every computer entry involves the possibility of an error, this requirement tends to result in a greater number of defective lenses. The degree of run-out and wobble are also measured and entered into the computer so that corrections can be made automatically as the outer lens surface is cut; this additional data entry requirement introduces the possibility of further errors.

Drawback collets are typically used to hold the block which carries the partially formed lens blank. However, the shaft diameter of the block is subject to manufacturing tolerances. Since the closed axial position of a drawback collet is related to the diameter of the block's shank, with the collet being drawn back further as the block's shank diameter decreases, this manufacturing variation from block to block introduces an additional possibility for error, even if batches of lenses can be formed with known and consistent center thicknesses.

The entire procedure described above is slow, cumbersome and subject to error. Variations in blocking can result from mechanical tolerances, wax thickness and errors in the blocking system, and yield unusable or poor quality lenses. Furthermore, the center thickness measurement is subject to operator error, and this data may be incorrectly recorded or assigned to the wrong lens in a production run. A separate and sometimes different center thickness must be used and entered into the computer when the front surface for each successive lens is generated; this procedure is also subject to error.

SUMMARY OF THE INVENTION

The present invention seeks to significantly reduce the possibility of error in mounting a partially formed lens blank to a block for generation of the outer lens surface, to eliminate the need for center thickness measurement prior to blocking, and to shorten the overall manufacturing process.

These goals are accomplished by the combination of a new technique for locating the posterior surface of the lens blank, a special blocking member that automatically establishes the distance to the lens posterior surface when the lens blank is mounted, and a modified spindle/collet construction that precisely aligns the blocking member (and thus the lens blank) to the spindle.

A reference surface is formed in the lens blank in the same procedure used to form the posterior surface. The position of the reference surface is fixed relative to the posterior surface, so that fixing the position of the reference surface inherently fixes the position of the posterior surface. The reference surface is preferably formed as a ledge surrounding the posterior surface, with one section parallel and another section orthogonal to the axis of the lens blank. The blocking member is provided with a structure that is complementary to the reference surface in the lens blank, so that the lens blank can be accurately positioned on the blocking member simply by mating the two complementary surfaces. The alignment structure on the blocking member is preferably a hollow cylinder.

The blocking member includes a flange with a rearward facing surface that is spaced a precisely known distance from its forward alignment surface. The spindle collet is modified so that it is recessed into the interior of the spindle, whereby the rearward facing flange surface abuts directly against the forward end of the spindle when the blocking member is in place. Since the lens blank is held with its posterior surface at a precisely known location relative to the blocking member, and the blocking member is held at a precisely known position relative to the spindle, the position of the posterior lens surface relative to the spindle is also precisely known without the need to measure the lens blank thickness. Thus, computer controlled formation of the outer lens surface can proceed without the extraneous data entry requirements of past procedures. Furthermore, the mating complementary surfaces of the lens blank and blocking member precisely align the two against undesired runout and wobble.

These and other features and advantages of the invention will be apparent to those skilled in the art from the following detailed description, taken together with the accompanying drawings, in which:

DETAILED DESCRIPTION OF THE INVENTION

The present invention calls for forming a reference surface in the lens blank at the same time the posterior (sagittal) surface is formed, and using the reference surface to automatically align the lens blank with the blocking member and spindle for creation of the outer lens curve. To accomplish this the position of the reference surface is accurately fixed with respect to the posterior surface, and the spindle/blocking mechanism is modified so that the position of the blocking member relative to the spindle is accurately known. This combination results in an automatic alignment of the lens blank and spindle prior to the formation of the outer lens curve, eliminating the need to measure the lens blank after the posterior surface has been formed, and without having to enter additional data regarding the position and thickness of the lens blank into the computer control for the lathe system. The automatic alignment capability at the same time substantially eliminates discrepancies in both prism and wobble, setting these factors either at zero or at a desired finite value.

Figure 5:
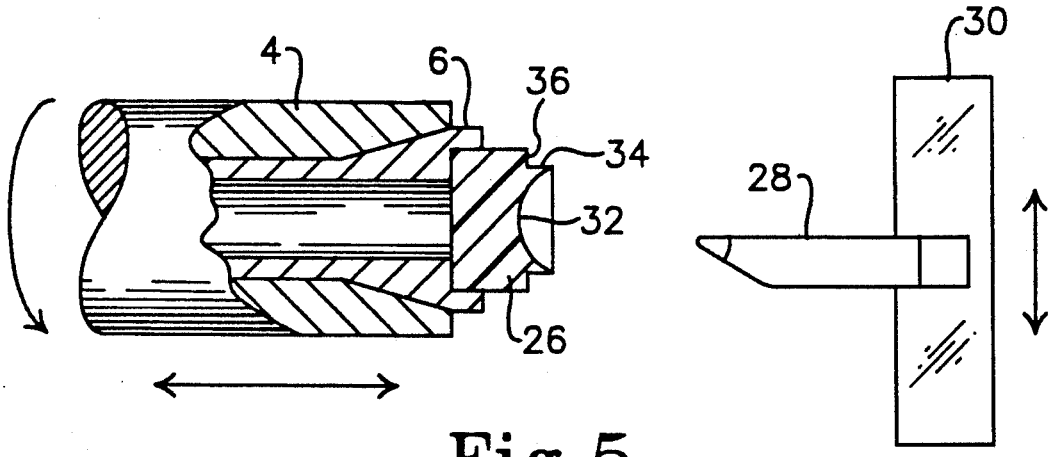
FIG. 5 is a fragmentary sectional plan view illustrating the formation of a posterior lens surface and reference surface in accordance with the present invention.

The invention will be described in detail in connection with a contact lens having a concave base curve for its posterior surface, although it is equally applicable to intra-ocular lenses having concave, flat or convex posterior surfaces. The base curve and reference surface can be generated with a conventional computer-controlled lathe system. FIG. 5 illustrates the operative portions of such a system which come in contact with a lens blank 26. They include a spindle 4, a collet 6, and a diamond-tipped cutting tool 28 that cuts into the lens blank as it is rotated on the spindle. The spindle is capable of movement along a horizontal axis as shown in FIG. 5, while cutting tool 28 is mounted on a slide 30 that moves along a vertical axis (in the plane of the page) as shown in the plan view. The base curve 32 is formed by moving the spindle horizontally against the cutting tool as the lens blank is rotated, and translating the cutting tool along the vertical axis indicated in the drawing. The computer control coordinates the movement of these two elements to form the desired curved lens surface.

Up to this point the formation of the lens is conventional. However, during this step an additional cut is made into the lens blank to form a reference surface that is used to precisely align the lens blank during the next stage of manufacture, when the outer lens curve is formed. The cutting tool 28 is first held stationary adjacent the edge of the base curve 32, and the spindle 4 is moved to the right as the lens blank is rotated about its axis to form a cylindrical surface 34 in the lens blank peripherally around the base curve 32. The cylindrical surface 34 could also be spaced radially outward beyond the outer limits of the base curve 32, but such a spacing is not necessary. Once the cylindrical surface 32 has been cut, translation of the spindle along its horizontal axis stops and the spindle is held in a fixed position while it continues to rotate. At this time the cutting tool 28 is moved radially outward from the center of the lens blank, forming a ledge 36 in the lens blank that is orthogonal to the cylindrical surface 34. The ledge 36 and cylindrical surface 34 function as reference surfaces which automatically align the lens blank for formation of the outer lens curve during the next stage of manufacture. Although the base curve 32 is illustrated as extending deeper into the lens blank at its center than the ledge 36, the ledge could alternately be made deeper or the same depth as the base curve.

Figure 6:
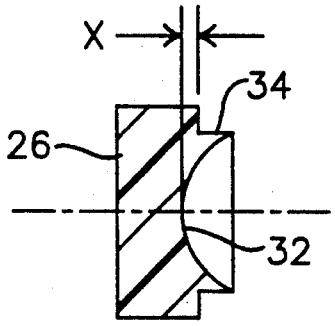
FIG. 6 is a sectional view of a lens blank after the posterior and reference surfaces have been formed.

Since the base curve 32 and reference surfaces 34, 36 are formed during the same manufacturing stage, under a common computer control, and without adjusting the position of lens blank 26, the relative positions of these surfaces can be very accurately controlled. The two dimensional factors that are used to automatically align the lens blank during subsequent formation of the outer lens curve are the spacing X between the maximum depth of the base curve 32 (indicated in enlarged FIG. 6), and the diameter of cylindrical surface 34.

Figure 7:
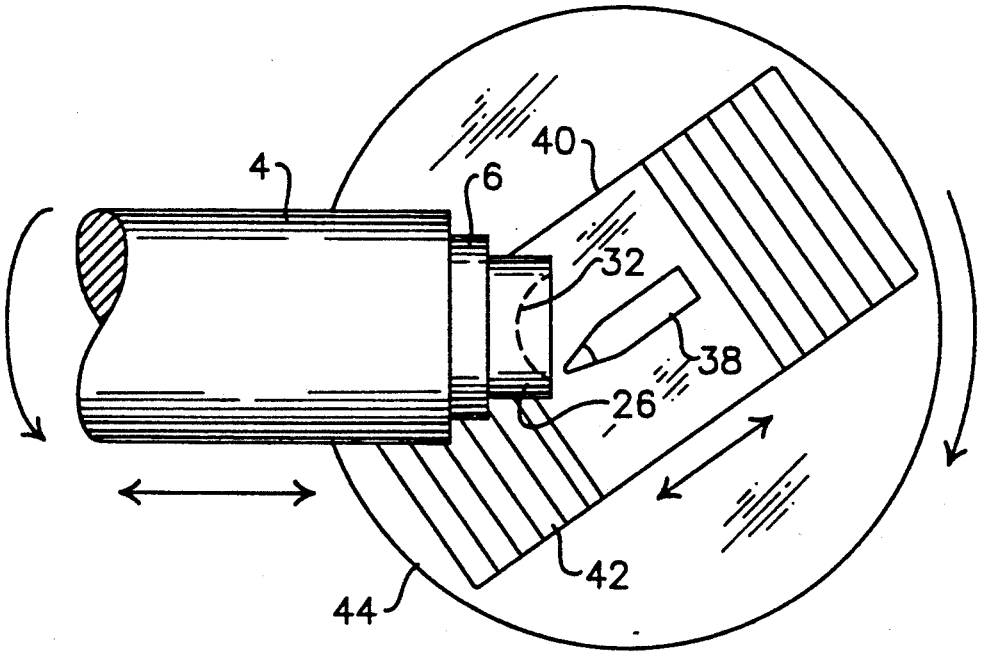
FIGS. 7 and 8 are fragmentary plan views of an alternate technique for fabricating the posterior and reference surfaces.

As an alternate to the vertically moving slide 30 of FIG. 5, a cutting tool 38 may be mounted on a slide 40 that moves along a radial track 42 on the upper surface of a rotary table 44, as illustrated in FIG. 7. By an appropriate coordination of the position of the slide along its track, the longitudinal spindle position, and the rotational orientation of table 44, again under computer control, base curve 32 is generated. Again, the formation of the base curve up to this point may be considered conventional.

Figure 8:
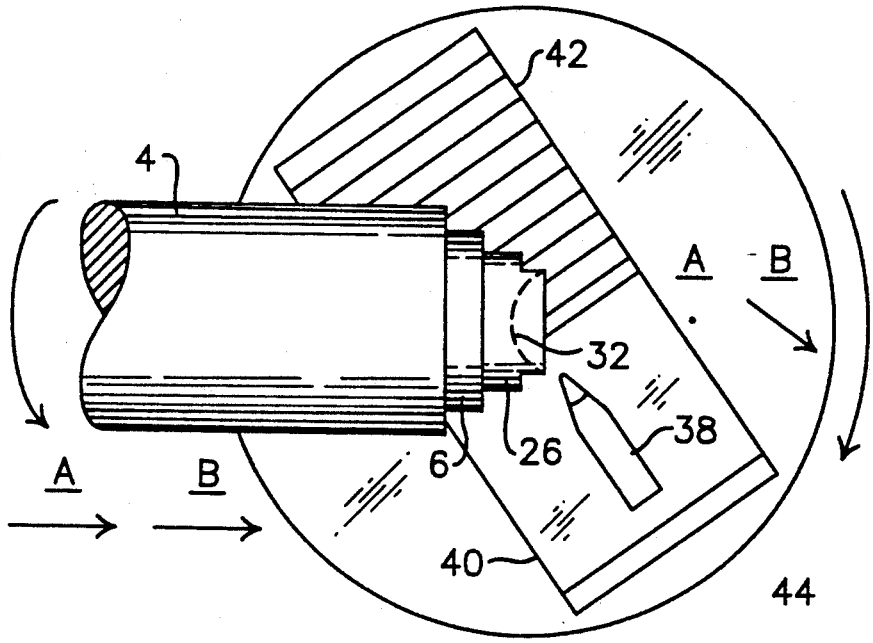

The formation of the reference surfaces 34 and 36 is a two-step process, illustrated in FIG. 8. In the first step the spindle 4 is moved axially to the right against the tip of the cutting tool 38 to form the cylindrical surface 34. The orthogonal ledge 36 is formed in the next step, in which the spindle 4 continues to move axially to the right, while the table 44 rotates and slide 40 moves radially outward to produce a net movement at the tip of cutting tool 38 which is oriented down and to the right. The movements of the spindle and of the cutting tool tip during these two steps are indicated by vector arrows under headings A and B in the drawing, with A referring to the first step and B to the second. The various movements are coordinated by the computer control so that ledge 36 is formed along a straight radial line.

Figure 1:
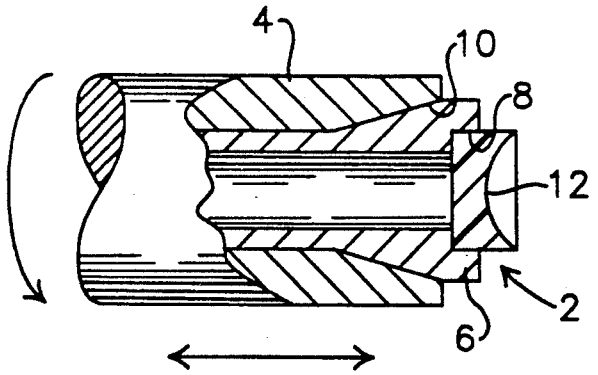
Fig.1 (Prior Art)
FIG. 1 is a sectional view of a lens blank held in a spindle for formation of a a posterior lens surface by a prior technique.
Figure 2:
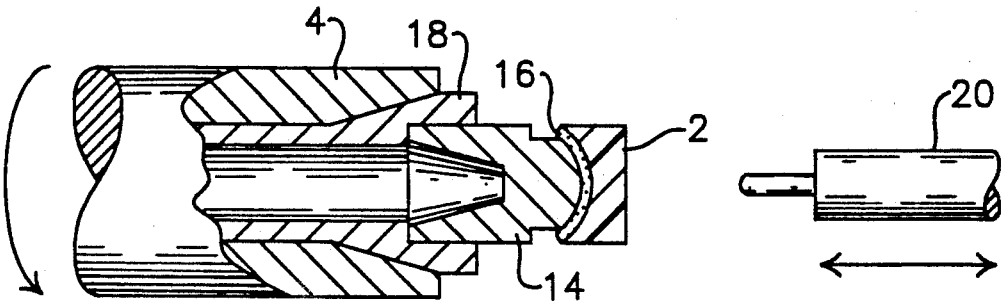
Fig.2 (Prior Art)
FIG. 2 is a sectional view of a later stage in the prior method, illustrating the formation of an outer lens surface.
Figure 3:
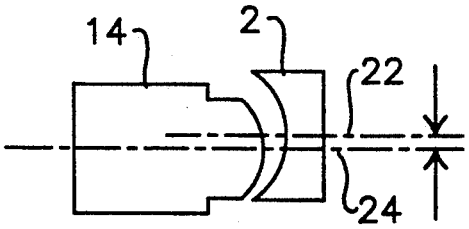
Fig.3 (Prior Art)
FIGS. 3 and 4 respectively illustrate lens "run-out" and "wobble"
Figure 4:
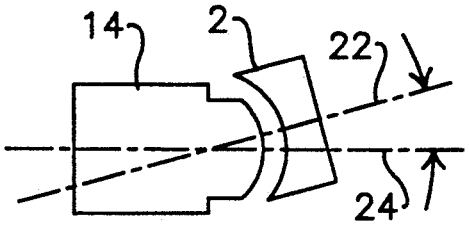
Fig.4 (Prior Art)
Figure 9:
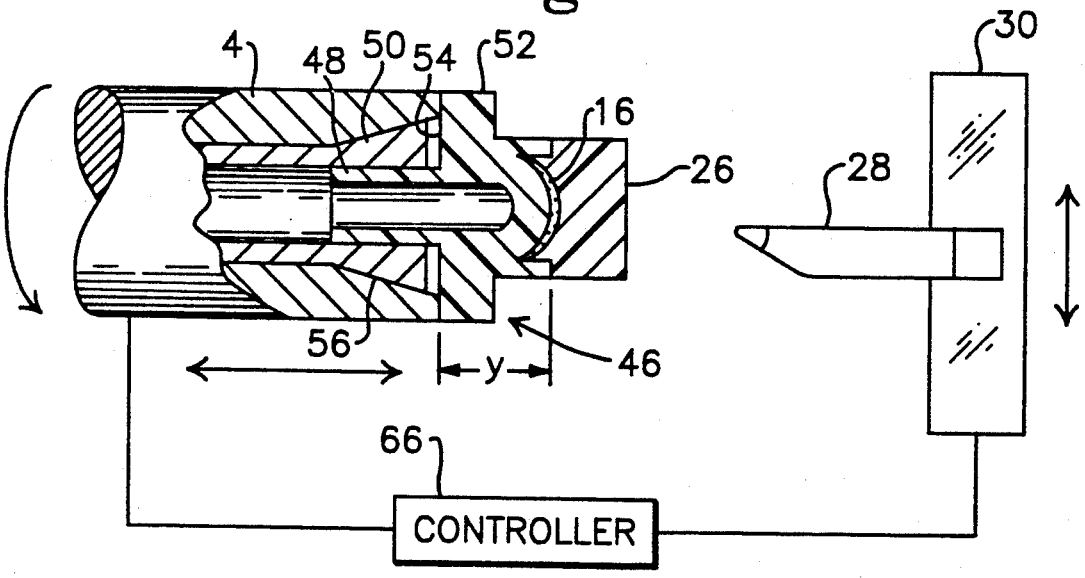
FIG. 9 is a fragmentary sectional plan view illustrating the formation of the outer lens surface in accordance with the invention.

A set-up for forming the outer lens surface in accordance with the invention is shown in FIG. 9, in which elements that are common to previous figures are indicated by the same reference numerals. A specially designed "dead length" blocking member 46 captures the lens blank 26 at its forward end by means of a conventional layer of wax 16. The wax can be applied from the outside, or via an optional axial passageway through the member. The blocking member includes a rearward directed shank 48 that is held by a collet 50 within the spindle 4. Extending out from the central portion of the blocking member is a flange 52 with a rearward facing surface 54 that abuts directly against the forward end of the spindle 4 when the blocking member is held in place by the collet 50. For this purpose the collet's outer sloped surface 56 is smaller in diameter when the blocking member is in place than that of a conventional collet 18 as shown in FIG. 2. The dimensions of the blocking member shank 48, collet 50 and spindle 4 are selected such that the collet will be recessed back from the forward end of the spindle over the full range of manufacturing tolerances in each of these parts. In addition to establishing a fixed reference position for the rear surface 54 of the blocking member flange relative to the spindle, this eliminates an additional source of uncertainty associated with the prior system of FIG. 2. In that system the position of the blocking member relative to the spindle could vary,k depending upon manufacturing tolerances for the different parts.

Blocking member 46 is manufactured so that its forward end has a shape that is complementary to that of the reference surfaces 34, 36 formed in the lens blank. For the lens blank configuration of FIG. 6, the blocking member will have a forward extension 58 (shown to a larger scale in FIG. 10) consisting of a hollow cylindrical surface 60 that extends forward from and lateral to the blocking member's head 62. The forward end surface 64 of the cylinder forms a ring that is orthogonal to its inner surface 60, and these two surfaces are in turn complementary to the reference surfaces 36 and 34, respectively, formed in the lens blank. That is, when the lens blank is mounted in place on the blocking member with its base surface 32 attached to the head of the blocking member via the wax interface 16, the cylindrical reference surface 34 abuts against the inner cylindrical surface 60 on the blocking member (subject to manufacturing tolerances), and the reference ledge 36 abuts against the outer ring 64 on the blocking member. The lens blank is pressed into the soft wax until its references surfaces abut the complementary surfaces on the blocking member.

The blocking member 46 is carefully manufactured so that the distance between the rearward facing surface 54 of flange 52 and the forward facing surface of alignment ring 64 is precisely known; this dimension is denoted Y in FIG. 9. Since the distance between the depth of the lens base curve 32 and the reference surface 36 (and thus the alignment ring 64) is precisely established as dimension X during the first stage of manufacture, the distance between the forward end of the spindle and the maximum depth of the lens base curve is precisely established as Y+X. Based upon this known distance, the computer controller 66 can guide the movements of both the spindle 4 and the slide 30 to form the desired outer lens surface 68, without having to either measure the thickness of the lens blank prior to mounting it on blocking member 46, probe the lens blank after it has been mounted to determine its position, or enter any of this information into the computer. The possibility of undesired prism or wobble is also virtually eliminated, since the inner cylindrical surface 60 precisely positions the lens blank relative to the blocking member head when it is mounted.

A rotating table with a sliding tool mount could be used instead of the slide 30 in FIG. 9. In this event the table would be rotated so that the cutting tool is on the opposite side of the table's center from spindle 4, thereby allowing the convex curve 68 to be cut in the lens blank. In either case, it may be desirable to perform the machining in two stages, first with a roughing tool and then with a finishing tool.

Figure 10:
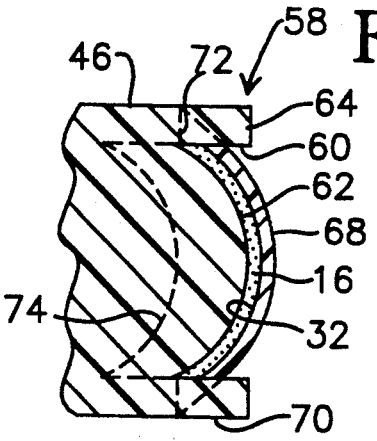
FIG. 10 is an enlarged fragmentary sectional view showing a completed contact lens prior to removal from the blocking member used in the invention.

The lens is shown in FIG. 10 after formation of its outer surface 68. It is next polished, removed from the wax and cleaned. If it has been held on by a vacuum channel within the blocking member rather than with wax, the vacuum is simply terminated. While the outer surface 68 is being formed, the cutting tool 28 will generally cut away the corner 70 of the cylindrical extension 58. This can be remedied by simply re-machining the blocking member after use to shorten the extension 58 so that its surfaces 60, 64 are again complementary to the reference surfaces 34, 36 on the lens blank. The new outer surface of the extension is indicated by dashed line 72, and the new head surface by dashed line 74. The lathe computer is re-programmed prior to manufacture of the next lens to reflect the shorter dimension Y. For volume manufacturing, a large number of lenses can be formed with a corresponding number of blocking members, with each of the blocking members pre-machined in a batch operation after the first round of lenses has been formed.

The blocking member 46 is preferably formed from a plastic-like polycarbonate so that its front corner can be cut during formation of the outer lens surface without interfering with that operation, and also so it can be molded with a high degree of dimensional accuracy. A metal blocking member could also be used, but is not as desirable. Molding the critical dimensions of the blocking member to a 5 micron tolerance will assure proper alignment for currently available contact lenses.

The invention as described above thus offers a greater degree of control and quality in the manufacture of contact lenses, together with a reduction in the number of manufacturing steps and the accompanying opportunities for error. While specific embodiments have been described, numerous variations and alternate embodiments will occur to those skilled in the art. For example, while radial and axial reference surfaces are preferred for the lens blank, these surfaces could be formed at other angles, so long as corresponding adjustments are made to the blocking member. Accordingly, it is intended that the invention be limited only in terms of the appended claims.

We claim:

1. A lens forming system, comprising:

means for forming a posterior surface in a contact lens blank corresponding to a desired inner surface for the lens, and a flat annular reference surface at a known location in the lens blank relative to said inner surface, a support structure, and a blocking means for carrying said lens blank with its surface opposite to said inner surface facing outward for formation of an outer lens surface, said blocking means being mountable to said support structure and including means for alignment at a known position relative to said support structure, said blocking means further including a flat forward directed surface that is complementary to the reference surface on said lens blank, and abuts said reference surface when the lens blank is carried by said blocking means, for positioning the lens blank at a known position relative to said blocking means, such that said inner lens surface is at a known position with respect to said support structure and said outer lens surface can be formed in said lens blank based upon the position of said support structure, said support structure comprising a spindle with an interior bore that is sloped outward at its forward end, and an associated collet for mounting the blocking means to said spindle, said collet being retained within said spindle bore and having an exterior surface that is sloped outward at its forward end complementary to the slope of said spindle bore, said blocking means including a shank which is engaged by said collet and a fixed positioned flange for aligning the blocking means with respect to said spindle, said spindle having a flat forward end which abuts the flange on said blocking means, the distance between said flange and said complementary blocking means surface determining the position between said inner lens surface and said spindle, and said collet terminating rearward of the spindle's forward end by an amount sufficient to recess the collet back from the abutment between the spindle's forward end and said blocking means flange over a full range of manufacturing tolerances.

2. A blocking member for carrying a lens blank in which an inner lens surface has been formed and positioning the lens blank for formation of an outer lens surface, comprising:

a central portion, a spindle engaging member extending rearward from said central portion, a flange extending outward from said central portion, said flange having a rearward facing surface disposed to abut against a spindle when said spindle engaging member is held by the spindle, and a lens blank engagement member extending forward from said central member, said lens blank engagement member including a forward curved surface for capturing the inner lens surface of said lens blank, and a positioning member lateral to said forward curved surface for abutting against a flat annular reference surface on said lens blank lateral to said inner lens surface, said positioning member comprising a forward extending hollow cylindrical member having a flat, ring-like forward facing surface for positioning the lens blank along an axis parallel to, and an inner surface for positioning the lens blank along an axis orthogonal to, the axis of the cylindrical member, the distance between said rearward facing flange surface and said positioning member determining the distance between a lens blank held by said blocking member and a spindle which holds the blocking member.

3. The blocking member of claim 2, wherein the forward curved surface of said lens blank engagement member is formed to receive an adhesive wax for capturing the inner surface of said lens blank, allowing said lens blank to be inserted into said wax, after the wax has been placed on said forward engagement member surface, until said positioning member abuts against said lateral portion of the lens blank.

4. The blocking member of claim 2, said flange extending peripherally around the central portion of said blocking member.

5. A mounting structure for a lens blank in which a posterior surface corresponding to a desired inner surface, and a flat annular reference surface at a known depth in the blank relative to said inner surface, have been formed, comprising:

a spindle having a forward end, a blocking member for carrying said lens blank, said blocking member including a flange having a rearward facing surface, and a forward extending lens blank engagement member that includes a forward curved surface for capturing the inner lens surface of said lens blank and a positioning member lateral to said forward curved surface, said positioning member including a flat ring-like surface that faces forward to abut against said lens blank reference surface and thereby position the lens blank with respect to the blocking member, and means for mounting said blocking member to said spindle so that the rearward facing surface of said flange abuts against a reference location on said spindle and positions the blocking member relative to the spindle, said spindle having an interior bore that is sloped outward at its forward end, said means for mounting the blocking member to the spindle comprising a collet retained within said spindle bore and having an exterior surface that is sloped outward at its forward end complementary to the slope of said spindle bore, said blocking member including a shank which is engaged by said collet, said collet terminating rearward of the spindle's forward end by an amount sufficient to recess of the collet back from the forward end of said spindle over a full range of manufacturing tolerances, so that said blocking member abuts directly against said forward spindle end.

6. A mounting structure for a lens blank in which a posterior surface corresponding to a desired inner surface, and a flat annular reference surface at a known depth in the blank relative to said inner surface, have been formed, comprising:

a spindle having a forward end, a blocking member for carrying said lens blank, said blocking member including a flange having a rearward facing surface, and a forward extending lens blank engagement member that includes a forward curved surface for capturing the inner lens surface of said lens blank and a positioning member lateral to said forward curved surface, said positioning member including a flat ring-like surface that faces forward to abut against said lens blank reference surface and thereby position the lens blank with respect to the blocking member, said positioning member comprising a forward extending hollow cylindrical member having a forward end with said flat ring-like surface, said cylindrical member being dimensioned for said flat ring-like surface to abut said reference surface along an area contact and to position the lens blank along an axis parallel to the axis of the cylindrical member, and means for mounting said blocking member to said spindle so that the rearward facing surface of said flange abuts against a reference location on said spindle and positions the blocking member relative to the spindle.

7. The mounting structure of claim 6, said cylindrical member further including an inner surface dimensioned to abut and to position the lens blank along an axis orthogonal to the axis of the cylindrical member.

8. A mounting structure for a lens blank in which a posterior surface corresponding to a desired inner surface, and a flat annular reference surface at a known depth in the blank relative to said inner surface, have been formed, comprising:

a spindle having a forward end, a blocking member for carrying said lens blank, said blocking member including a flange having a rearward facing surface, and a forward extending lens blank engagement member that includes a forward curved surface for capturing the inner lens surface of said lens blank and a positioning member lateral to said forward curved surface, said positioning member including a flat ring-like surface that faces forward to abut against said lens blank reference surface and thereby position the lens blank with respect to the blocking member, said forward curved surface being formed to receive an adhesive wax for capturing the inner surface of said lens blank, allowing said lens blank to be inserted into said wax, after the wax has been placed on said forward engagement member surface, until said positioning member abuts against said lens blank reference surface, and means for mounting said blocking member to said spindle so that the rearward facing surface of said flange abuts against a reference location on said spindle and positions the blocking member relative to the spindle.

9. The blocking member of claim 3, wherein the lens blank engagement and positioning members of said blocking member are formed relative to said lens blank reference and posterior surfaces to allow for only a thin film of wax between the lens blank engagement member's forward surface and the lens blank's posterior surface.

10. A mounting structure for a lens blank in which a posterior surface corresponding to a desired inner surface, and a flat annular reference surface at a known depth in the blank relative to said inner surface, have been formed, comprising:

a spindle having a forward end, a blocking member for carrying said lens blank, said blocking member including a flange having a rearward facing surface, and a forward extending lens blank engagement member that includes a forward curved surface for capturing the inner lens surface of said lens blank and a positioning member lateral to said forward curved surface, said positioning member including a flat ring-like surface that faces forward to but against said lens blank reference surface and thereby position the lens blank with respect to the blocking member, the forward curved surface of said lens blank engagement member being formed to receive an adhesive wax for capturing the inner surface of said lens blank, allowing said lens blank to be inserted into said wax, after the wax has been placed on said forward engagement member surface, until said positioning member abuts against said lens blank reference surface, said lens blank engagement and positioning members being formed relative to said lens blank reference and posterior surfaces to allow for only a thin film of wax between the lens blank engagement member's forward surface and the lens blank's posterior surface, and means for mounting said blocking member to said spindle so that the rearward facing surface of said flange abuts against a reference location on said spindle and positions the blocking member relative to the spindle.

* * * * *